US012543897B2

(12) United States Patent
Kuo

(10) Patent No.: US 12,543,897 B2
(45) Date of Patent: Feb. 10, 2026

(54) SUPPORTING FRAME ASSEMBLY AND SUPPORTING FRAME THEREOF

(71) Applicant: Jerry Kuo-yung Kuo, Taichung (TW)

(72) Inventor: Jerry Kuo-yung Kuo, Taichung (TW)

( * ) Notice: Subject to any disclaimer, the term of this patent is extended or adjusted under 35 U.S.C. 154(b) by 120 days.

(21) Appl. No.: 18/665,393

(22) Filed: May 15, 2024

(65) Prior Publication Data

US 2025/0241492 A1 Jul. 31, 2025

(30) Foreign Application Priority Data

Jan. 26, 2024 (TW) ..... 113200972

(51) Int. Cl.
*A47B 96/06* (2006.01)
*A47K 3/00* (2006.01)

(52) U.S. Cl.
CPC ..... *A47K 3/003* (2013.01)

(58) Field of Classification Search
CPC .. A47K 3/003; A47K 2201/025; A47K 10/10; A47K 10/12; A47K 17/022; A47K 3/281
See application file for complete search history.

(56) References Cited

U.S. PATENT DOCUMENTS

2018/0274722 A1* 9/2018 Worden, IV ..... A47K 5/02
2018/0283604 A1* 10/2018 Garcia ..... F16M 13/02
2022/0330697 A1* 10/2022 Moss ..... A47B 96/06

* cited by examiner

*Primary Examiner* — Amy J. Sterling
(74) *Attorney, Agent, or Firm* — Osha Bergman Watanabe & Burton LLP

(57) ABSTRACT

A supporting frame adapted to be attached to a bracket that is mounted on a wall is provided. The supporting frame includes a frame body, a latch, and an elastic component. The frame body includes an inner surface and an engaging portion that is disposed on the inner surface. The engaging portion is configured to detachably engage the bracket. The latch includes a latching end and an operation end. The operation end is operable to rotate the latch between a locking position where the latching end is adapted to abut against the bracket, and an unlocking position where the latching end is adapted to disengage from the bracket. The elastic component is disposed between the latch and the frame body and is adapted to apply an elastic force to the latch for pushing the latch toward the locking position.

20 Claims, 10 Drawing Sheets

SUPPORTING FRAME ASSEMBLY AND SUPPORTING FRAME THEREOF

CROSS-REFERENCE TO RELATED APPLICATION

This application claims priority to Taiwanese Utility Model Patent Application No. 113200972, filed on Jan. 26, 2024, the entire disclosure of which is incorporated by reference herein.

FIELD

The disclosure relates to a supporting frame, and more particularly to a supporting frame adapted to be used in a bathroom.

BACKGROUND

A conventional supporting frame assembly as disclosed in Taiwanese Utility Model Patent No. M460624 includes a fixing bracket that is mounted on a wall with two screws, a supporting frame that is engaged to the fixing bracket, and a set screw that secures the supporting frame to the fixing bracket.

Since the supporting frame is locked to the fixing bracket by the set screw, when the supporting frame is to be replaced or repaired, a hexagonal wrench that matches the set screw has to be used to loosen or tighten the set screw in order to remove or install the supporting frame.

Therefore, whether the supporting frame can be removed or installed depends on whether a hexagonal wrench matching the set screw is available, which is inconvenient in operation. In addition, the action of loosening or tightening the set screw is not only time-consuming, but also easily blocked by the wall and difficult to operate.

SUMMARY

Therefore, an object of the disclosure is to provide a supporting frame and a supporting frame assembly that can alleviate at least one of the drawbacks of the prior art.

According to an aspect of the disclosure, the supporting frame is adapted to be attached to a bracket that is mounted on a wall. The supporting frame includes a frame body, a latch, and an elastic component.

The frame body is adapted to be mounted on the bracket along an installation direction. The frame body has an inner surface that is adapted to face the bracket, and an engaging portion that is disposed on the inner surface and that is configured to detachably engage the bracket.

The latch is rotatably disposed on the inner surface of the frame body. The latch includes a latching end that is spaced apart from the engaging portion along the installation direction, and an operation end that is opposite to the latching end. The operation end is operable to rotate the latch between a locking position where a distance between the engaging portion and the latching end is the smallest and the latching end is adapted to abut against the bracket, and an unlocking position where the distance between the engaging portion and the latching end is the largest and the latching end is adapted to disengage from the bracket, thereby enabling the frame body to be disengaged from the bracket.

The elastic component is disposed between the latch and the inner surface of the frame body, and is adapted to apply an elastic force to the latch for pushing the latch toward the locking position.

According to another aspect of the disclosure, the supporting frame assembly is adapted to be mounted on a wall. The supporting frame assembly includes a bracket that is adapted to be mounted on the wall, and a supporting frame that is detachably attached to the bracket. The supporting frame includes a frame body, a latch, and an elastic component.

The frame body is mounted on the bracket along an installation direction. The frame body has an inner surface that faces the bracket, and an engaging portion that is disposed on the inner surface and that detachably engages the bracket.

The latch is rotatably disposed on the inner surface of the frame body. The latch includes a latching end and an operation end. The latching end is spaced apart from the engaging portion along the installation direction. The operation end is opposite to the latching end, and is operable to rotate the latch between a locking position where a distance between the engaging portion and the latching end is smallest and the latching end is adapted to abut against the bracket, and an unlocking position where the distance between the engaging portion and the latching end is largest and the latching end is adapted to disengage from the bracket, thereby enabling the frame body to be disengaged from the bracket.

The elastic component is disposed between the latch and the inner surface of the frame body, and is adapted to apply an elastic force to the latch for pushing the latch toward the locking position.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
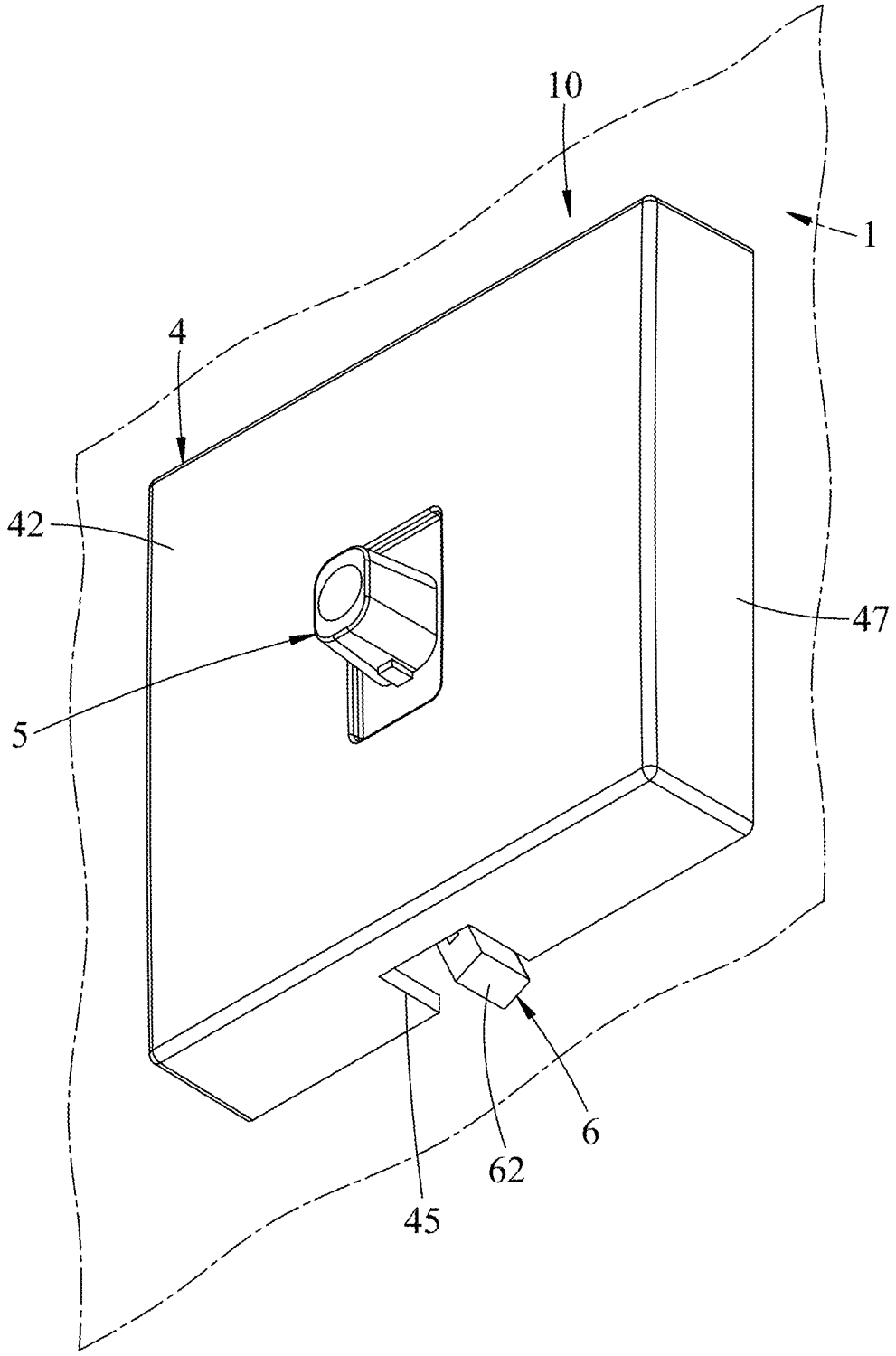
FIG. 1 is a perspective view illustrating a supporting frame assembly mounted on a wall according to an embodiment of the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
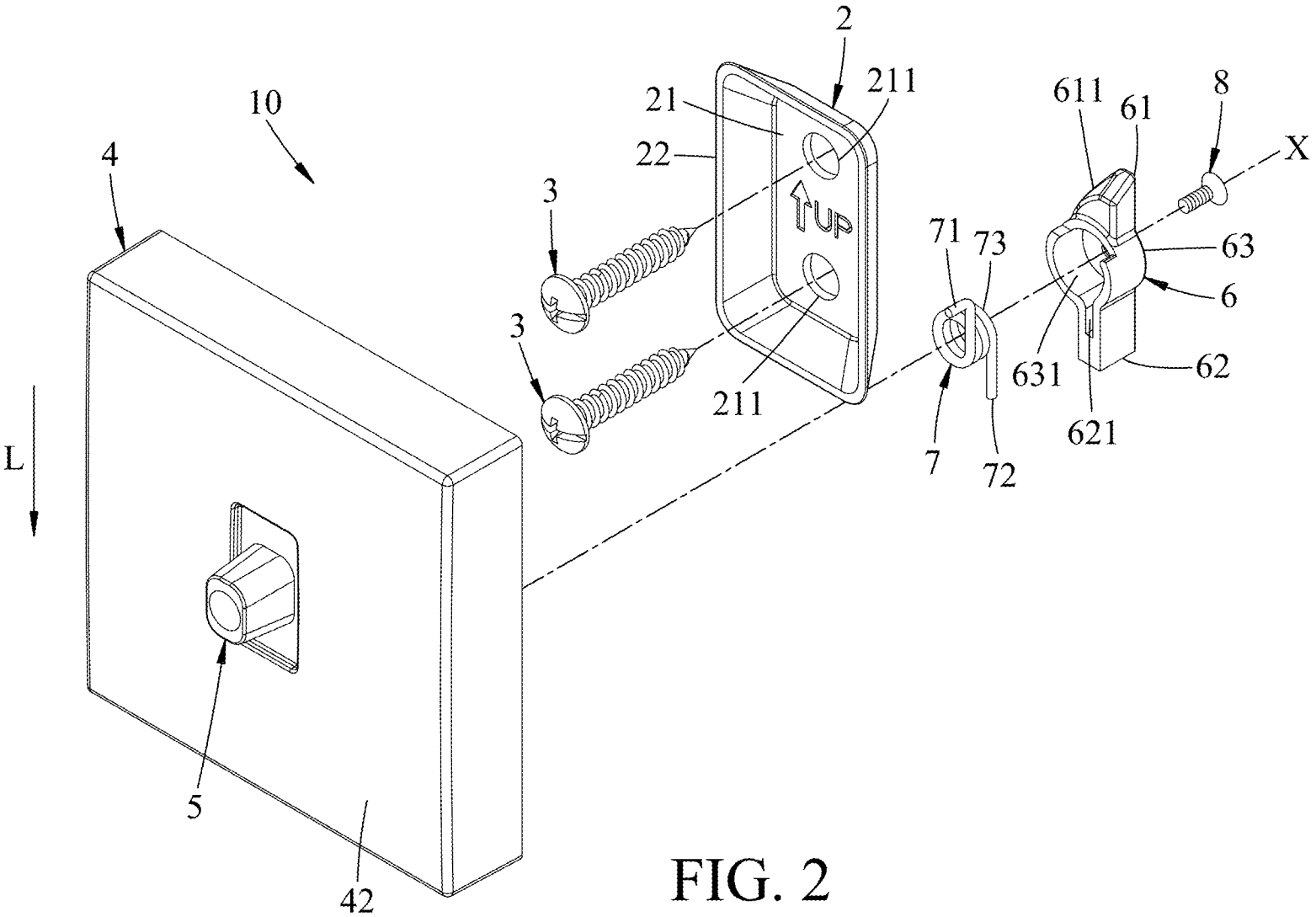
FIG. 2 is an exploded perspective view of the supporting frame assembly according to an embodiment of the present disclosure.
Figure 3:
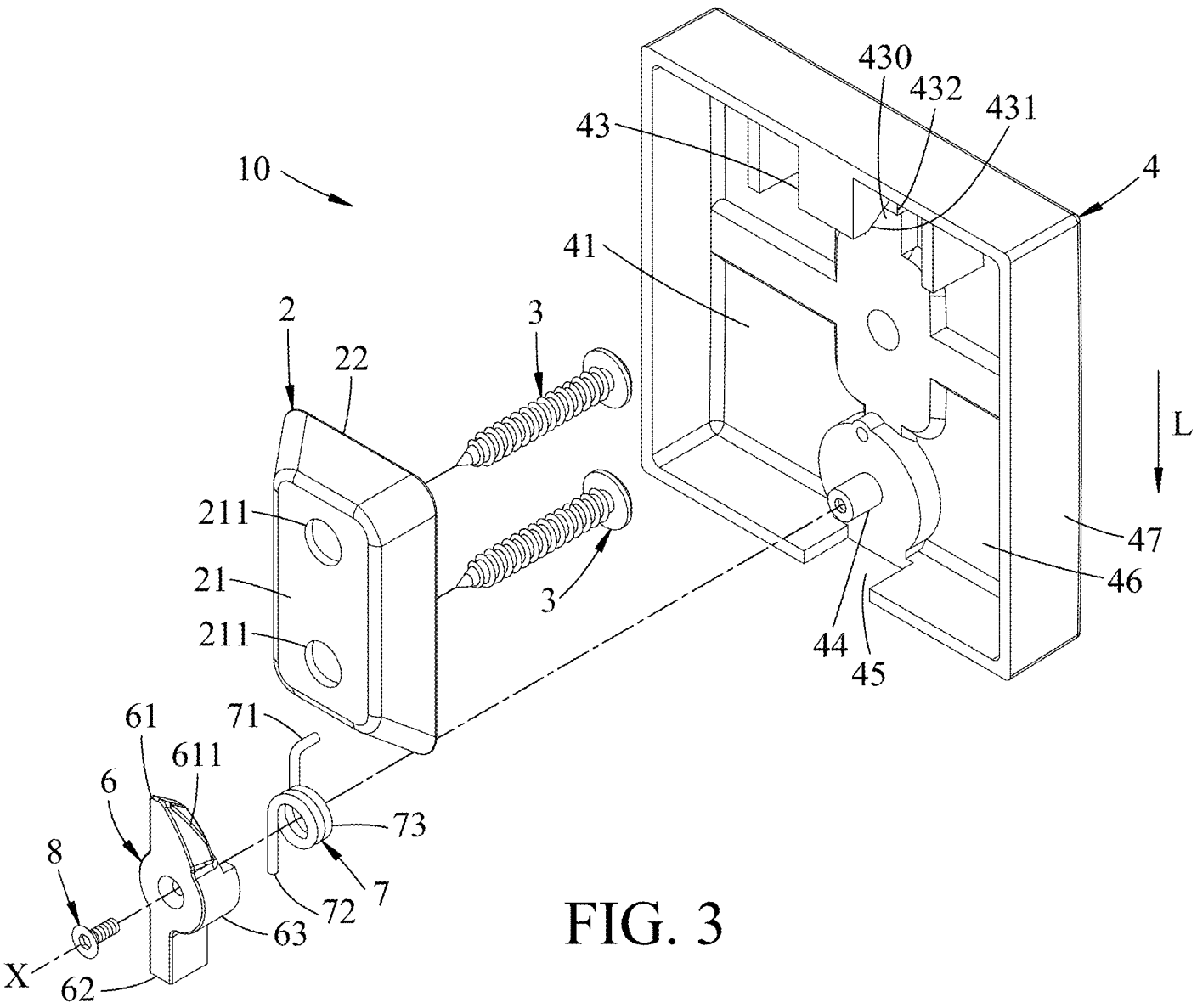
FIG. 3 is an exploded perspective view of the supporting frame assembly viewed from another angle according to an embodiment of the present disclosure.

Referring to FIGS. 1 to 3, a supporting frame assembly 10 according to an embodiment of this disclosure is adapted to be mounted on a wall 1. For example, the supporting frame assembly 10 can be used in a bathroom. The supporting frame assembly 10 includes a bracket 2 that is adapted to be mounted on the wall 1, two fasteners 3, and a supporting frame that is detachably attached to the bracket 2. The supporting frame includes a frame body 4, an accessory 5, a latch 6, an elastic component 7, and a connecting component 8.

The bracket 2 is adapted to be mounted on the wall 1. The bracket 2 includes a flat panel 21 that is adapted to be attached to the wall 1, and a rim 22 that surrounds the flat panel 21 and that is connected to a periphery of the flat panel 21. The flat panel 21 is formed with two through holes 211. The rim 22 is inclined outward from the flat panel 21.

In this embodiment, the fasteners 3 are exemplified as screws. The fasteners 3 are adapted to be connected to the wall 1 for mounting the bracket 2 on the wall 1. In specific, the fasteners 3 extend respectively through the through holes 211 of the flat panel 21 of the bracket 2 in a direction parallel to a rotation axis (X) of the latch 6 (hereinafter referred to as "axial direction"), and then are inserted into the wall 1. It should be noted that a number of the fasteners 3 is not limited to two. In other embodiments, the number of the fasteners 3 may be one or three or more, and a number of the through holes 211 should be the same as the number of the fasteners 3.

Figure 4:
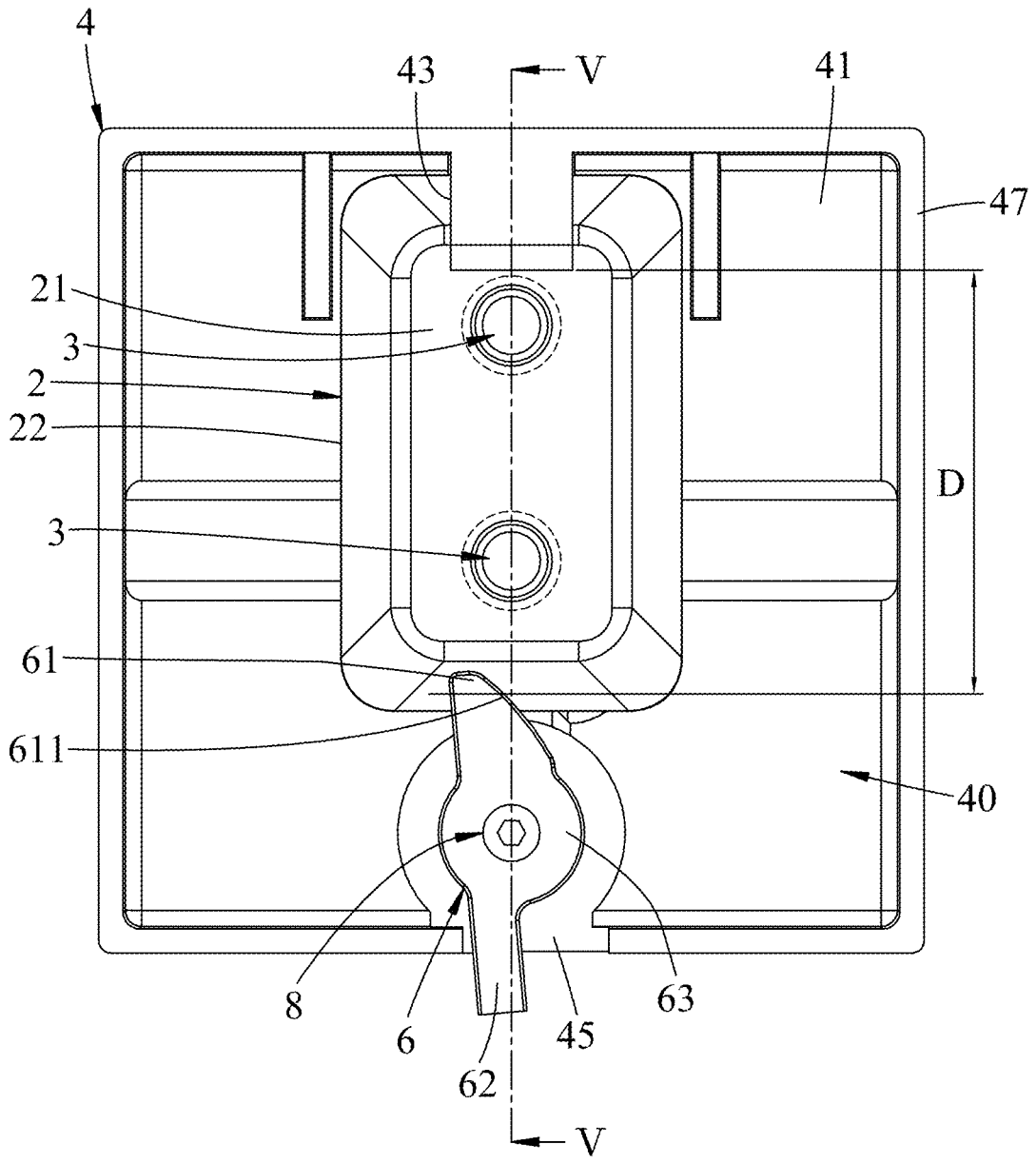
FIG. 4 is a rear view illustrating a latch in a locking position according to an embodiment of the present disclosure.
Figure 5:
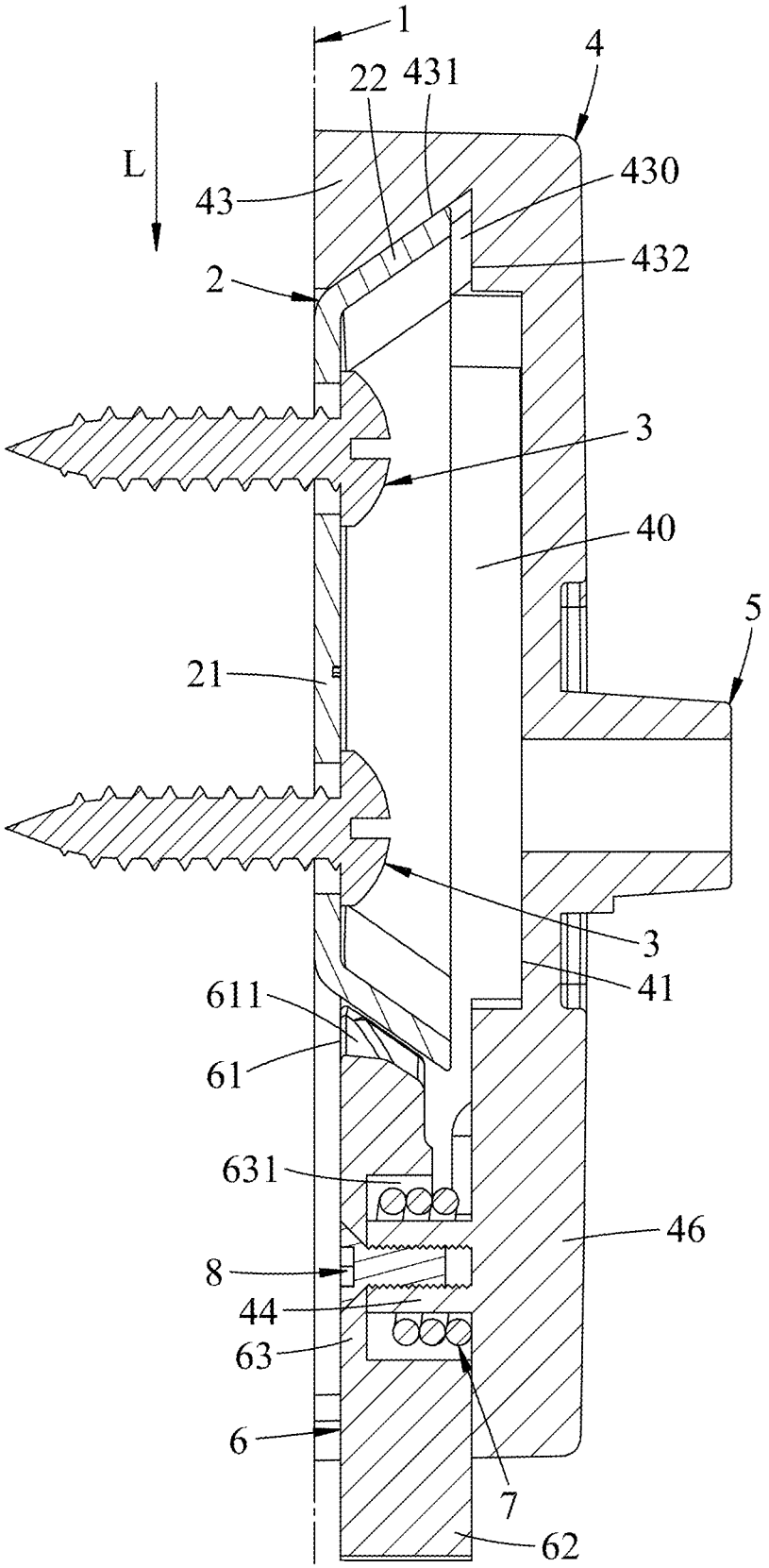
FIG. 5 is a cross-sectional view taken along line V-V in FIG. 4.

Referring to FIGS. 2 to 5, the frame body 4 is detachably mounted on the bracket 2 along an installation direction (L) (i.e., a downward direction as shown in FIGS. 2, 3 and 5). The frame body 4 has an inner surface 41 that faces the bracket 2 and that is spaced apart from the wall 1 along the axial direction, an outer surface 42 that is opposite to the inner surface 41, an engaging portion 43 that is disposed on the inner surface 41 at an edge of the frame body 4, and a stud 44 that is disposed on the inner surface 41 and that is spaced apart from the engaging portion 43 along the installation direction (L).

The frame body 4 further includes a base wall 46 and a surrounding wall 47. The base wall 46 has the inner surface 41. The surrounding wall 47 extends from a periphery of the base wall 46 in the axial direction, cooperates with the base wall 46 to define an inner space 40, and is formed with an opening 45.

The engaging portion 43 is configured to detachably engage the bracket 2. The engaging portion 43 has an abutting surface 431 that abuts against the rim 22 of the bracket 2, and a blocking surface 432 that extends in the installation direction (L). The blocking surface 432 is parallel to the installation direction (L), and the abutting surface 431 is inclined relative to the blocking surface 432. The blocking surface 432 cooperates with the abutting surface 431 to define a recess 430. In specific, the recess 430 of the engaging portion 43 is configured to detachably engage the bracket 2, where a part of the rim 22 of the bracket 2 is disposed in the recess 430.

The stud 44 projects from the inner surface 41 along the rotation axis (X) of the latch 6.

The opening 45 of the surrounding wall 47 is spaced apart from the engaging portion 43 along the installation direction (L), and is located at an edge of the frame body 4 opposite to the engaging portion 43.

Figure 8:
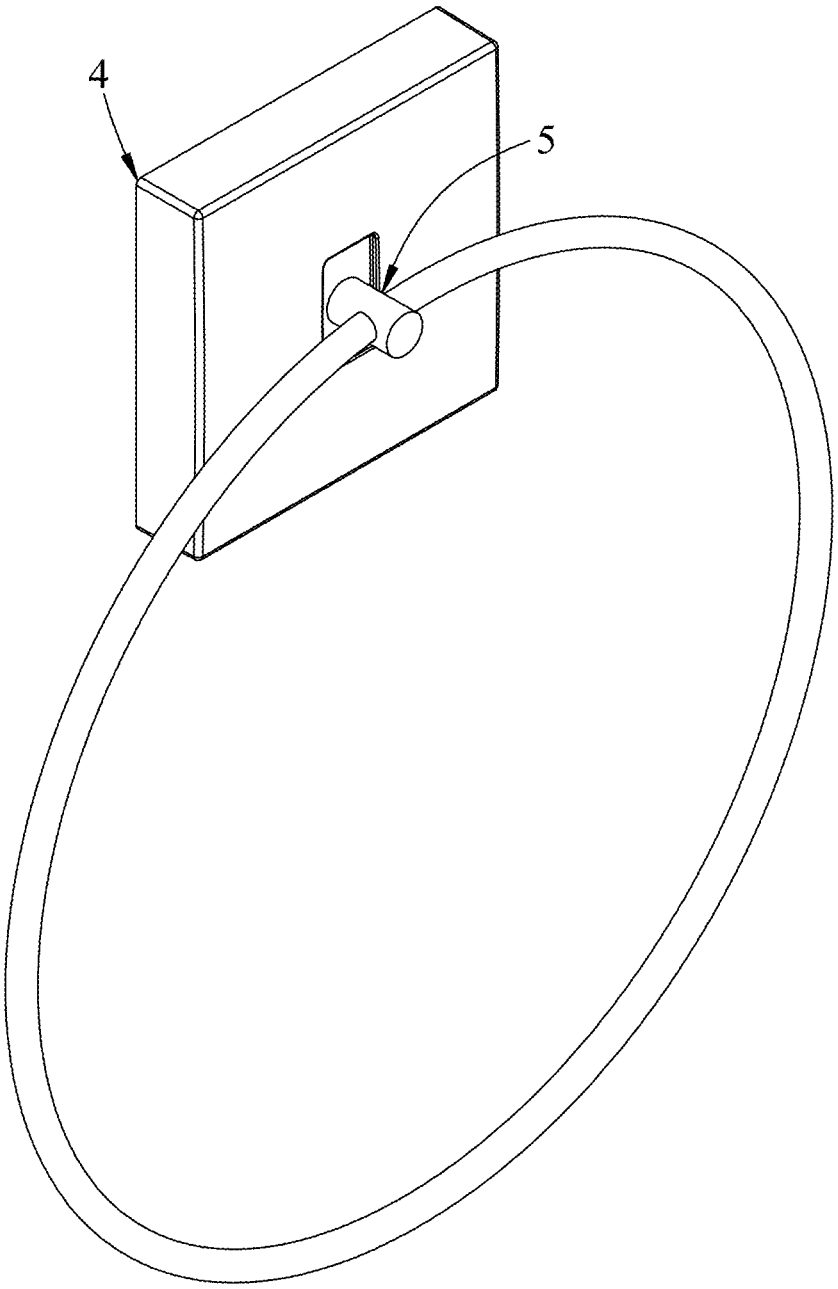
FIG. 8 is a perspective view illustrating an example of an accessory mounted on a frame body according to an embodiment of the present disclosure.
Figure 9:
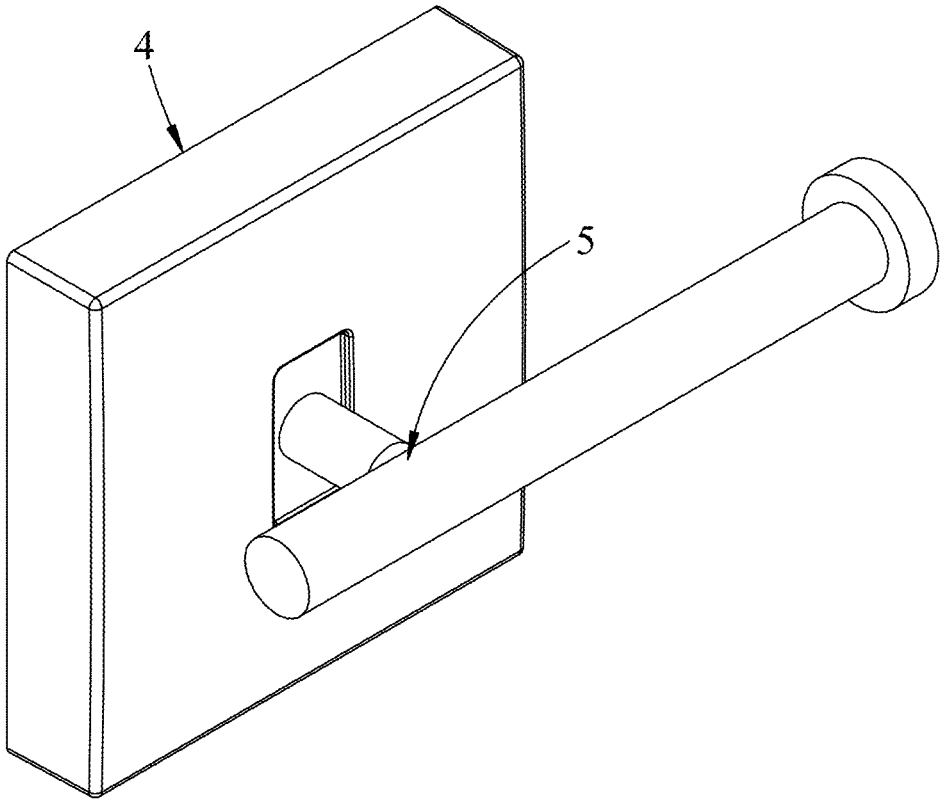
FIG. 9 is a perspective view illustrating another example of an accessory mounted on the frame body according to an embodiment of the present disclosure.

The accessory 5 is disposed on the frame body 4. In this embodiment, the accessory 5 is exemplified as a column (as shown in FIGS. 1 and 2). However, the accessory 5 may be a ring, a rod or a combination thereof (e.g., a combination of the column and a ring as shown in FIG. 8, or a combination of the column and a rod as shown in FIG. 9), and is not limited to the abovementioned examples.

The latch 6 is rotatably disposed on the inner surface 41 of the frame body 4; that is to say, the latch 6 is rotatable about the rotation axis (X). In this embodiment, the latch 6 includes a latching end 61 that is spaced apart from the engaging portion 43 along the installation direction (L), an operation end 62 that is opposite to the latching end 61, and a pivot portion 63 that is connected between the latching end 61 and the operation end 62.

The latching end 61 is disposed in the inner space 40, and has a curved surface 611 that faces the bracket 2. In specific, the curved surface 611 faces the rim 22 of the bracket 2.

The operation end 62 extends through the opening 45 of the surrounding wall 47, and is formed with a slot 621 that has an opening facing the inner surface 41 of the frame body 4. In specific, a part of the operation end 62 is exposed out of the surrounding wall 47 (as shown in FIGS. 1, 4 and 6) of the frame body 4 along the installation direction (L).

The pivot portion 63 is rotatably sleeved on the stud 44 of the frame body 4, and is formed with a receiving space 631 that has an opening facing the inner surface 41 of the frame body 4 and that is in spatial communication with the slot 621.

Figure 6:
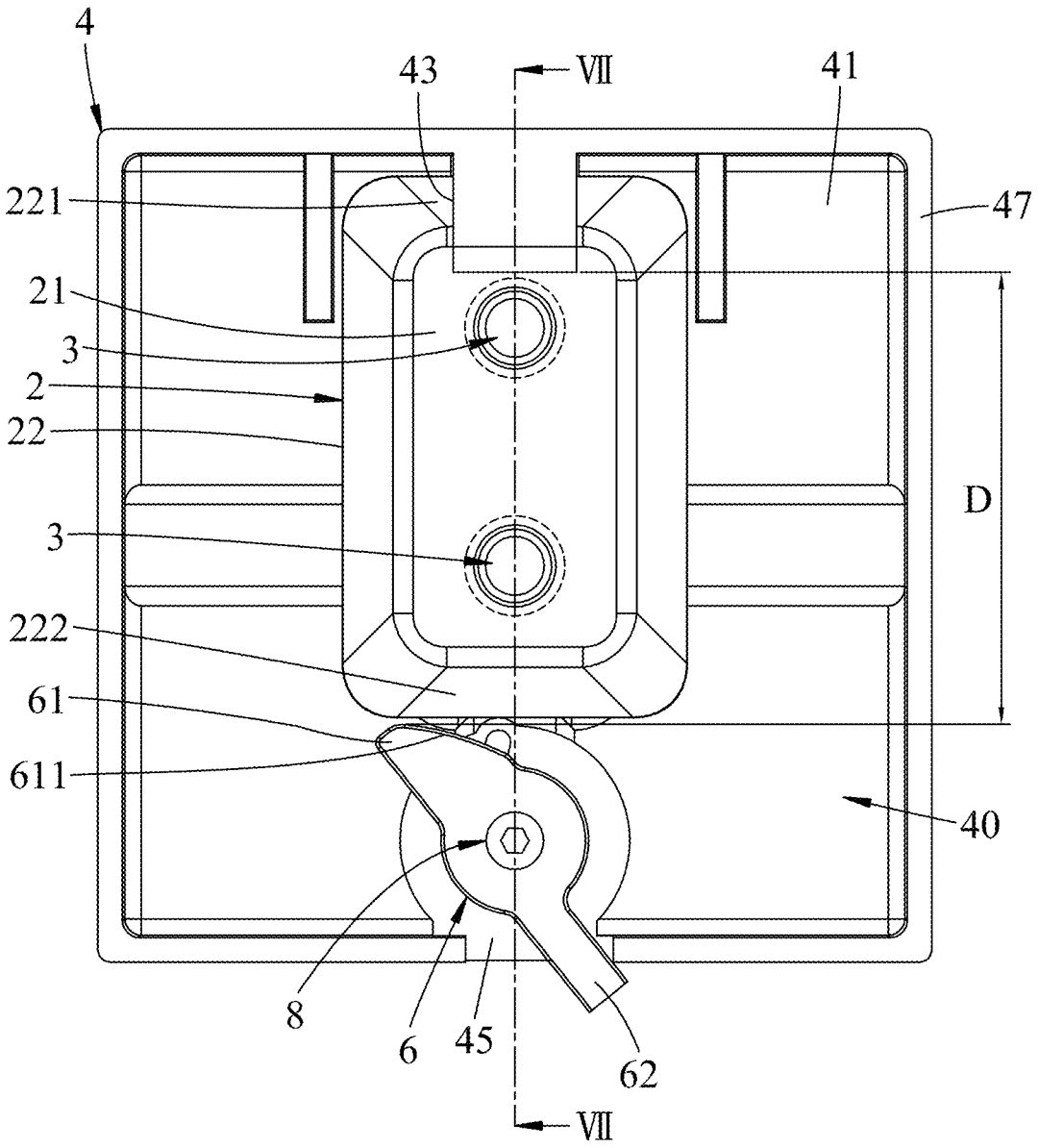
FIG. 6 is a rear view illustrating the latch in an unlocking position according to an embodiment of the present disclosure.
Figure 7:
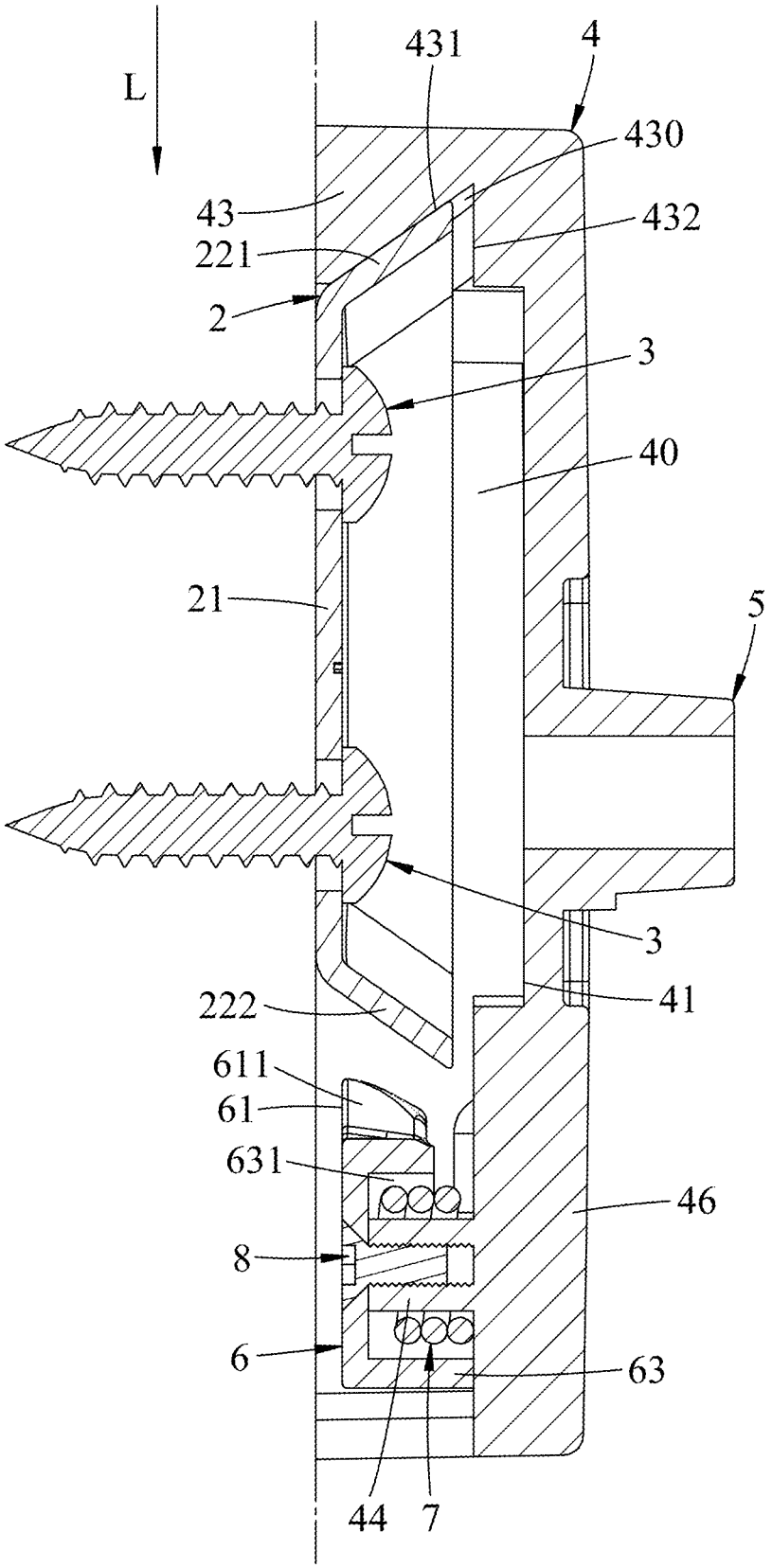
FIG. 7 is a cross-sectional view taken along line VII-VII in FIG. 6.

Referring to FIGS. 4 to 7, the operation end 62 is operable to rotate the latch 6 between a locking position (as shown in FIGS. 4 and 5) and an unlocking position (as shown in FIGS. 6 and 7). In the locking position, a distance (D) between the engaging portion 43 and the latching end 61 is the smallest, and the latching end 61 abuts against the rim 22 of the bracket 2. In the unlocking position, the distance (D) between the engaging portion 43 and the latching end 61 is the largest, and the latching end 61 disengages from the bracket 2, thereby enabling the frame body 4 to be disengaged from the bracket 2.

Referring to FIGS. 2 to 5, the elastic component 7 is disposed between the latch 6 and the inner surface 41 of the frame body 4, and is exemplified as a torsion spring in this embodiment. The elastic component 7 has a first end 71 that is inserted into the inner surface 41 of the frame body 4 (i.e., into the base wall 46) along the axial direction, a second end 72 that is opposite to the first end 71 and that is connected to the operation end 62 of the latch 6, and a coil portion 73 that is connected between the first end 71 and the second end 72. In specific, the second end 72 of the elastic component 7 is disposed in the slot 621 of the operation end 62, and the coil portion 73 is disposed in the receiving space 631 of the pivot portion 63 and is sleeved on the stud 44 of the frame body 4. The elastic component 7 is secured between the inner surface 41 and the operation end 62, and is adapted to apply an elastic force to the latch 6 for pushing the latch 6 toward the locking position.

The connecting component 8 extends through the pivot portion 63 along the rotation axis (X) of the latch 6 and is connected to the frame body 4. In specific, the pivot portion 63 of the latch 6 and the elastic component 7 are sleeved on the stud 44 together, and the connecting component 8 extends through the pivot portion 63 and is connected to the stud 44. The latch 6 is rotatable about the connecting component 8 and the stud 44. In this embodiment, the connecting component 8 is a screw, and the stud 44 is formed with a threaded hole.

In order to install the supporting frame on the bracket 2, a user has to first turn the operation end 62 of the latch 6 in a counterclockwise direction (viewing in an angle as shown in FIGS. 4 and 6), so that the pivot portion 63 of the latch 6 rotates around the connecting component 8 and the stud 44 in the counterclockwise direction, thereby rotating the latch 6 from the locking position to the unlocking position. At this time, the user may place the frame body 4 on the bracket 2 along the installation direction (L), so as to make the frame body 4 abut against the bracket 2. In specific, the frame body 4 is aligned with the bracket 2 by engaging the recess 430 of the frame body 4 with an upper part 221 of the rim 22 that is at an upper side of the bracket 2 (see FIGS. 6 and 7). After the recess 430 of the frame body 4 is engaged with the upper part 221 of the rim 22, the user may push the frame body 4 in the axial direction toward the bracket 2 so that the latch 6, while is still in the unlocking position, is pushed to be vertically aligned with the bracket 2 in the installation direction (L). Then, the user may release the latch 6, so that the latch 6 may be caused to rotate by the elastic force provided by the elastic component 7 in the clockwise direction from the unlocking position to the locking position. During rotation of the latch 6 from the unlocking position to the locking position, the distance (D) between the engaging portion 43 and the latching end 61 is gradually reduced as a rotation angle of the latch 6 is gradually increased, and the curved surface 611 can guide the latching end 61 to abut against a lower part 222 of the rim 22 that is at a lower side of the bracket 2.

When the latch 6 is rotated to be in the locking position, the abutting surface 431 of the engaging portion 43 abuts against the upper part 221 of the rim 22, and the blocking surface 432 is adjacent to the upper part 221 of the rim 22 in the axial direction. With the latching end 61 abutting against the lower part 222 of the rim 22 and the abutting surface 431 abutting against the upper part 221 of the rim 22, the frame body 4 is securely fastened to the bracket 2.

In order to disassemble the supporting frame from the bracket 2, similar to installation of the supporting frame to the bracket 2, a user has to turn the operation end 62 of the latch 6 in the counterclockwise direction to rotate the latch 6 from the locking position to the unlocking position. In specific, the distance (D) between the engaging portion 43 and the latching end 61 is gradually increased as the rotation angle of the latch 6 is gradually increased during rotation of the latch 6 from the locking position to the unlocking position.

Referring to FIGS. 6 and 7, when the latch 6 is in the unlocking position, the distance (D) between the engaging portion 43 and the latching end 61 is the largest and the latching end 61 is able to be detached from the lower part 222 of the rim 22, and thus the frame body 4 may be detached from the bracket 2 along a direction opposite to the installation direction (L) (i.e., an upward direction according to FIGS. 5 and 7).

It should be noted that, rotation directions of the latch 6 is not limited to turning counterclockwise to turn the latch 6 to the unlocking position, and turning clockwise to turn the latch 6 to the locking position. In other embodiments, the rotation directions of the latch 6 may be opposite, where turning clockwise may be to turn the latch 6 to the unlocking position and turning counterclockwise may be to turn the latch 6 to the locking position. In addition, the operation end 62 of the latch 6 may not be exposed out of the frame body 4 through the opening 45 of the surrounding wall 47. In other embodiments, the operation end 62 may be disposed within the inner space 40 and not exposed out of the frame body 4, where the user may insert a fingertip into the opening 45 to rotate the operation end 62 of the latch 6.

Figure 10:
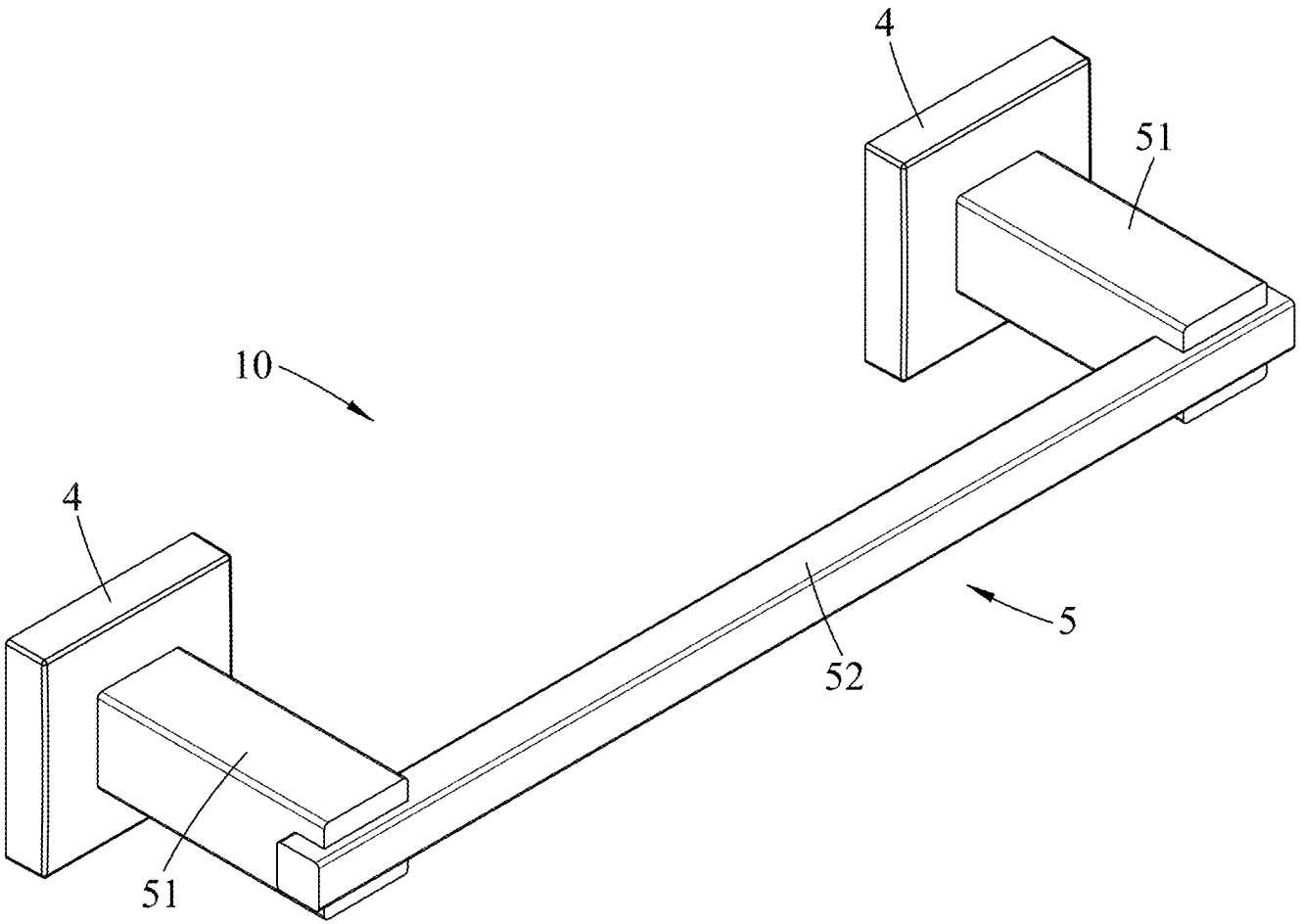
FIG. 10 is a perspective view illustrating yet another example of an accessory, where the accessory is mounted on two frame bodies according to an embodiment of the present disclosure.

Referring to FIG. 10, the supporting frame according to the embodiment of this disclosure is not limited to being used alone. In the embodiment shown in FIG. 10, the supporting frame assembly 10 includes two brackets 2 (not shown in FIG. 10), and two supporting frames mounted respectively on the brackets 2. The supporting frames are used together for supporting the accessory 5 that is used for hanging towels, clothes, or other items thereon. The accessory 5 includes two columns 51 connected respectively to the frame bodies 4 respectively of the supporting frame, and a bar 52 that has two opposite ends connected respectively to the columns 51.

In sum, the supporting frame according to the embodiments of this disclosure may be easily installed to or disassembled from the bracket 2 by a user through operating the operation end 62 of the latch 6 without using any tools, thereby improving the convenience of disassembling and installing the supporting frame. Besides, since a direction in which a user applies force to the operation end 62 for operating the latch 6 is parallel to the wall 1, the operation of the latch 6 will not be affected or blocked by the wall 1, thereby improving the ease and comfort of operating the latch 6. Furthermore, in some embodiments, a user will be clearly aware of the presence of the latch 6 by virtue of the design of the operation end 62 projecting out of the frame body 4 through the opening 45 of the surrounding wall 47, and thus the user may easily and quickly understand how to install or disassemble the supporting frame, thereby improving the installation and disassembly efficiency.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A supporting frame adapted to be attached to a bracket that is mounted on a wall, said supporting frame comprising:

a frame body adapted to be mounted on the bracket along an installation direction, said frame body having an inner surface that is adapted to face the bracket, and an engaging portion that is disposed on said inner surface and that is configured to detachably engage the bracket;

a latch rotatably disposed on said inner surface of said frame body, and including a latching end that is spaced apart from said engaging portion along the installation direction, and an operation end that is opposite to said latching end and that is operable to rotate said latch between a locking position where a distance between said engaging portion and said latching end is smallest and said latching end is adapted to abut against the bracket, and an unlocking position where the distance between said engaging portion and said latching end is largest and said latching end is adapted to disengage from the bracket, thereby enabling said frame body to be disengaged from the bracket; and an elastic component disposed between said latch and said inner surface of said frame body and adapted to apply an elastic force to said latch for pushing said latch toward the locking position.

2. The supporting frame as claimed in claim 1, further comprising a connecting component, said latch further including a pivot portion that is connected between said latching end and said operation end, said connecting component extending through said pivot portion along a rotation axis of said latch and being connected to said frame body, said latch being rotatable about said connecting component.

3. The supporting frame as claimed in claim 2, wherein said elastic component is a torsion spring, and has a first end inserted into said inner surface of said frame body along a direction parallel to the rotation axis, a second end opposite to said first end and connected to said operation end of said latch, and a coil portion connected between said first end and said second end.

4. The supporting frame as claimed in claim 3, wherein said operation end is formed with a slot that has an opening facing said inner surface of said frame body, and said pivot portion is formed with a receiving space that has an opening facing said inner surface of said frame body and that is in spatial communication with said slot; and wherein said second end of said elastic component is disposed in said slot of said operation end, and said coil portion is disposed in said receiving space.

5. The supporting frame as claimed in claim 2, wherein said latching end has a curved surface that is adapted to face the bracket, and the distance between said engaging portion and said latching end is gradually reduced as a rotation angle of said latch is gradually increased during rotation of said latch from the unlocking position to the locking position, and the distance is gradually increased as the rotation angle of said latch is gradually increased during rotation of said latch from the locking position to the unlocking position.

6. The supporting frame as claimed in claim 2, wherein said frame body further has a stud that is disposed on said inner surface, that is spaced apart from said engaging portion along the installation direction, and that projects from said inner surface along the rotation axis, said pivot portion of said latch and said elastic component are sleeved on said stud, and said connecting component extends through said pivot portion and is connected to said stud.

7. The supporting frame as claimed in claim 1, wherein said frame body includes a base wall, and a surrounding wall that extends from a periphery of said base wall in a direction parallel to a rotation axis of said latch, that cooperates with said base wall to define an inner space, and that is formed with an opening; and wherein said latching end of said latch is disposed in said inner space, and said operation end extends through said opening of said surrounding wall.

8. The supporting frame as claimed in claim 7, wherein a part of said operation end is exposed out of said frame body through said opening of said surrounding wall along the installation direction.

9. The supporting frame as claimed in claim 1, further comprising an accessory that is mounted on said frame body, and that includes one of a ring, a rod, a column and a combination thereof.

10. A supporting frame assembly adapted to be mounted on a wall, comprising:

a bracket adapted to be mounted on the wall; and a supporting frame detachably attached to said bracket, and including a frame body mounted on said bracket along an installation direction, said frame body having an inner surface that faces said bracket, and an engaging portion that is disposed on said inner surface and that detachably engages said bracket, a latch rotatably disposed on said inner surface of said frame body, and including a latching end that is spaced apart from said engaging portion along the installation direction, and an operation end that is opposite to said latching end and that is operable to rotate said latch between a locking position where a distance between said engaging portion and said latching end is smallest and said latching end is adapted to abut against the bracket, and an unlocking position where the distance between said engaging portion and said latching end is largest and said latching end is adapted to disengage from said bracket, thereby enabling said frame body to be disengaged from said bracket, and an elastic component disposed between said latch and said inner surface of said frame body and adapted to apply an elastic force to said latch for pushing said latch toward the locking position.

11. The supporting frame assembly as claimed in claim 10, wherein said bracket includes a flat panel adapted to be attached to the wall, and a rim surrounding said flat panel and connected to a periphery of said flat panel.

12. The supporting frame assembly as claimed in claim 11, further comprising a fastener that extends through said flat panel of said bracket in a direction parallel to a rotation axis of said latch, and that is adapted to be connected to the wall for mounting said bracket on the wall.

13. The supporting frame assembly as claimed in claim 11, wherein said engaging portion has an abutting surface abutting against said rim of said bracket, and a blocking surface extending in the installation direction and cooperating with said abutting surface to define a recess, a part of said rim being disposed in said recess.

14. The supporting frame assembly as claimed in claim 11, wherein said rim is inclined outward from said flat panel.

15. The supporting frame assembly as claimed in claim 10, further comprising a connecting component, said latch further including a pivot portion that is connected between said latching end and said operation end, said connecting component extending through said pivot portion along a rotation axis of said latch and being connected to said frame body, said latch being rotatable about said connecting component.

16. The supporting frame assembly as claimed in claim 15, wherein said elastic component is a torsion spring, and has a first end inserted into said inner surface of said frame body along a direction parallel to the rotation axis, a second end opposite to said first end and connected to said operation end of said latch, and a coil portion connected between said first end and said second end.

17. The supporting frame assembly as claimed in claim 15, wherein said frame body further has a stud that is disposed on said inner surface, that is spaced apart from said engaging portion along the installation direction, and that projects from said inner surface along the rotation axis, said pivot portion of said latch and said elastic component are sleeved on said stud, and said connecting component extends through said pivot portion and is connected to said stud.

18. The supporting frame assembly as claimed in claim 10, wherein said frame body further includes a base wall, and a surrounding wall that extends from a periphery of said base wall in a direction parallel to a rotation axis of said latch, that cooperates with said base wall to define an inner space, and that is formed with an opening; and wherein said latching end of said latch is disposed in said inner space, and said operation end extends through said opening of said surrounding wall.

19. The supporting frame assembly as claimed in claim 18, wherein a part of said operation end is exposed out of said frame body through said opening of said surrounding wall along the installation direction.

20. The supporting frame assembly as claimed in claim 10, further comprising an accessory that is mounted on said frame body, and that includes one of a ring, a rod, a column and a combination thereof.

* * * * *